US005727881A

United States Patent [19]

Domke

[11] Patent Number: 5,727,881

[45] Date of Patent: Mar. 17, 1998

[54] OVERPRESSURE VALVE FOR A PACKAGING CONTAINER

[75] Inventor: Klaus Domke, Ditzingen, Germany

[73] Assignee: Robert Bosch, GmbH, Stuttgart, Germany

[21] Appl. No.: 750,283

[22] PCT Filed: Mar. 7, 1996

[86] PCT No.: PCT/DE96/00402

§ 371 Date: Nov. 24, 1996

§ 102(e) Date: Nov. 27, 1996

[87] PCT Pub. No.: WO96/30280

PCT Pub. Date: Oct. 3, 1996

[30] Foreign Application Priority Data

Mar. 27, 1996 [DE] Germany ..... 195 10 489.7

[51] Int. Cl.[6] ..... B65D 33/01

[52] U.S. Cl. ..... 383/103; 220/203.11; 220/203.15; 220/203.18

[58] Field of Search ..... 383/103, 102; 220/203.11, 203.13, 203.14, 203.15, 203.16, 203.18, 367.1, 373, 231; 215/307, 310

[56] References Cited

U.S. PATENT DOCUMENTS

| | | | |
|---|---|---|---|
| 830,859 | 9/1906 | Smith | 215/310 X |
| 4,122,993 | 10/1978 | Glas | 383/103 |
| 4,206,870 | 6/1980 | DeVries | 383/103 |
| 5,263,777 | 11/1993 | Domke | 383/103 |
| 5,427,839 | 6/1995 | Buchner et al. | 383/103 X |

*Primary Examiner*—Jes F. Pascua
*Attorney, Agent, or Firm*—Edwin E. Greigg; Ronald E. Greigg

[57] ABSTRACT

An overpressure valve for a packaging container which includes a base plate with a central valve hole that coincides with a hole in a wall of the container and a valve diaphragm. The valve diaphragm covers the valve hole and the adjoining zones and includes two parallel peripheral zones which form a channel along an adhesive-free middle zone. To keep the opening pressure of the overpressure valve slight and to simplify the manufacture of the tool for the valve hole, the valve hole is formed of two intersecting circular holes which extend longitudinally of the adhesive-free middle zone of the valve diaphragm.

15 Claims, 1 Drawing Sheet

OVERPRESSURE VALVE FOR A PACKAGING CONTAINER

PRIOR ART

The invention is based on an overpressure valve for a packaging container. Products that are vulnerable to oxygen, such as coffee, are packed in tightly sealed containers to prevent spoilage from oxygen in the air. However, since freshly roasted coffee produces carbon dioxide and hence builds up a pressure that bloats the package, causing it to burst, it is known to equip the packaging container with an overpressure valve. An overpressure valve, known for instance from European Patent Disclosure EP-A 0 023 703, which is disposed through a hole in the wall of the packaging container, has a flexible valve diaphragm that covers a circular valve hole in a base plate glued in sealed fashion to the wall of the packaging container, and which at a certain internal package pressure lifts up from the base plate, forming an outlet channel through which carbon dioxide gas can flow out of the package into the open. Even a slight internal package pressure unattractively bloats a bag package of flexible packaging material. In the above-mentioned overpressure valve, which has proven itself on the market, the opening pressure is approximately 5 mbar. To reduce the opening pressure, the present applicant, in the earlier German Patent Application P 44 35 492.4, has already proposed replacing the circular valve hole with an oblong hole. With this provision, the opening pressure can be lowered to about 3 mbar. A disadvantage, however, is that the tool for punching the oblong hole is relatively complicated to manufacture, since to attain a high-quality cutting edge a play of only a few micrometers can be present between the female and the male dies. It has also been found in practice that particularly with a circular hole, if there is a negative pressure in the packaging container, such as occurs on evacuation during closure of the packaging container, creasing of the valve diaphragm can occur. Such creasing causes a leak in the packaging container.

ADVANTAGES OF THE INVENTION

The overpressure valve for a packaging container according to the invention, has the advantage over the prior art that the tool for producing the valve hole can be manufactured more simply and thus less expensively. It is also possible, with the hole shaped according to the invention, to attain an at least equally low opening pressure as with the oblong hole. It has also been demonstrated that creasing of the valve diaphragm which previously occurred if there was a negative pressure in the packaging container no longer occurs when the valve hole is shaped according to the invention. It is also advantageous that sealant supplied centrally into the valve hole for sealing between the base plate and the valve diaphragm penetrates especially rapidly into the channel zone.

Further advantages and advantageous further features will become apparent from the description set forth below.

BRIEF DESCRIPTION OF THE DRAWING

One exemplary embodiment of the invention is shown in the drawing and will be described in further detail in the description below.

DESCRIPTION OF THE EXEMPLARY EMBODIMENT

Figure 1:
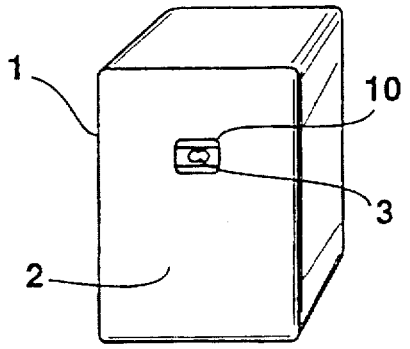
FIG. 1 shows a packaging container with an overpressure valve in a perspective view.
Figure 2:
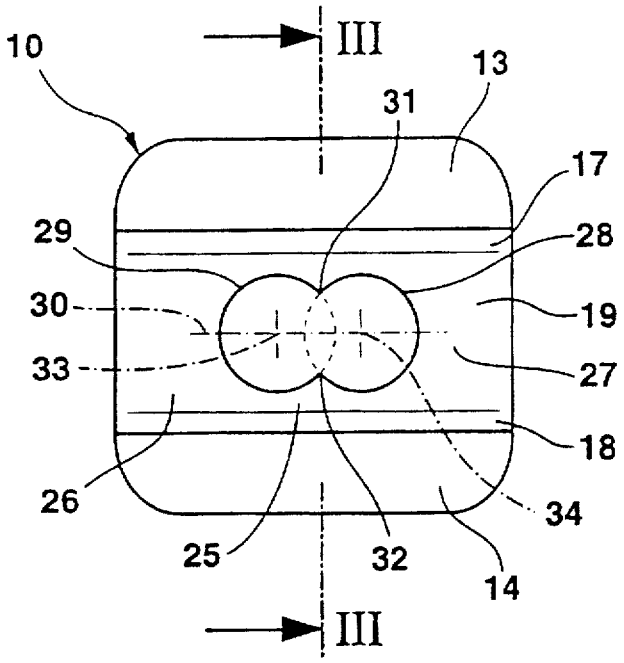
FIG. 2 shows the overpressure valve of FIG. 1 on a larger scale in plan view.
Figure 3:
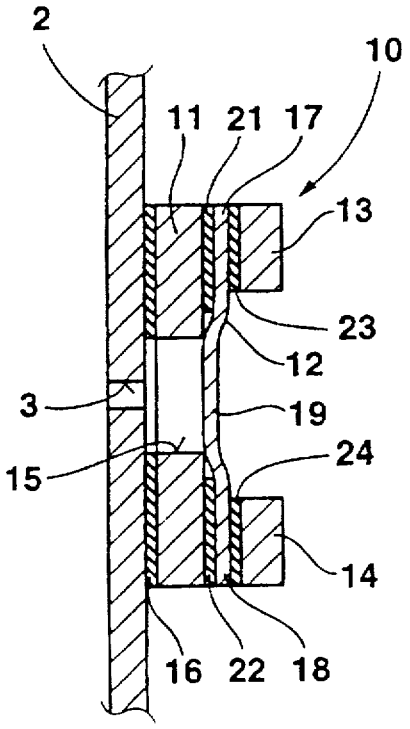
FIG. 3 shows the overpressure valve of FIG. 2 in cross section, in the plane III—III of FIG. 2.

On a side wall of a packaging bag 1, in which freshly roasted coffee, for instance, is packed in a sealed fashion, an overpressure valve 10 is secured in sealed fashion to the wall 2 above a through hole 3. The overpressure valve 10 has a stiff base plate 11 of a plastic film or sheet in the shape of a square with rounded corners, and with a central hole 15 which is larger than the hole 3. A valve diaphragm 12 made of a flexible, thin plastic film or sheet, coincides with the base plate and includes two parallel spacer strips 13, 14 of a stiff plastic film or sheet.

By means of an adhesive layer 16 on the outside of the wall 2 of the packaging bag 1, which surrounds the hole 3 in the bag the overpressure valve 10 is glued over a larger area of the bag to the underside of the base plate 11, the base plate 11 has a central valve hole 15; the valve hole 15 is aligned centrally with the through hole 3 in the wall 2 with the valve hole 15 surrounding the hole 3. The valve hole 15 is sealed off by the valve diaphragm 12, by use of two parallel peripheral zones 17, 18 which are firmly glued to the top of the base plate 11 by means of parallel adhesive layer 21, 22. The valve diaphragm 12 has a middle zone 19, left free of adhesive, whose central region 25 spans the valve hole 15, and which rests sealingly, in the pressureless state, by its outer regions 26, 27 on the top of the base plate 11. The outer regions 26 and 27 are free of any adhesive.

The parallel spacer strips 13, 14 are secured to the peripheral zones 17, 18, to which the valve diaphragm 12 and the base plate 11 are glued over a large area, by means of adhesive layers 23, 24; their outer edge is flush, with the outer edge of the valve diaphragm 12, and their width is somewhat less than the width of the adhesive layers 21, 22 with which the valve diaphragm 12 is secured to the base plate 11.

If pressure builds up in the interior of the packaging bag 1 from emission of carbon dioxide gas from the product in the package, for instance coffee, then the pressure acts through the through hole 3 in the wall 2 and the valve hole 15 in the base plate 11 upon the central region of the middle zone 19 of the valve diaphragm 12. As the pressure rises, the middle zone 19 bulges like a bubble and lifts up from the top of the base plate 11, so that eventually a channel forms between the base plate 11 and the middle zone 19 of the valve diaphragm 12 in the non-adhesive area along the parallel adhesive strips 21, 22 the channel extends as far as the free edges of the middle zone 19, and gas can flow out through the middle zone 19.

To keep the opening pressure of the overpressure valve 10 low, the valve hole 15 is formed of two intersecting circular holes 28, 29, of which the axis 30 connecting their centers extends in the direction of the longitudinal axis of the adhesive-free middle zone 19 of the valve diaphragm 12, or in other words longitudinally of the valve channel. The length of the valve hole 15 is preferably equal to or greater than half of the length of the base plate 11. The ratio of width to length of the valve hole 15 is in the range from 1:1.3 to 1:2. The overlap of the two holes 28, 29 forms two vertices 31, 32 in the valve hole 15, whose spacing from the axis 30 connecting the centers is dependent on the degree of overlap or in other words on the spacing between the centers 33, 34 of the holes 28, 29.

When there is an overpressure in the packing bag 1, the lifting up of the valve diaphragm 12 from the base plate 11 begins at the two vertices 31, 32 of the hole 15. As a result, the opening pressure of the overpressure valve 10 can be varied within certain limits by way of the location of the vertices 31, 32 or in other words the degree of overlap of the two holes 28, 29 and the spacing of the holes from the axis 30 connecting the centers. Once the overpressure in the packaging bag 1 has dropped, the valve diaphragm 12 finally presses against the base plate 11 again at the two vertices 31, 32 of the hole. It has been found in practice that as a result of the shape of the valve hole 15 according to the invention, the valve diaphragm 12 does not tend to crease and hence to leak in the event of negative pressure in the packaging bag 1. This is suspected to be associated with the fact that the two vertices 31, 32 of the hole form a kind of support prop, in the form of a negative pressure that prevents creasing of the valve diaphragm 12.

The tool for making the valve hole 15 can be manufactured simply by joining together two flattened cylindrical pins to make the male die. The female die can likewise be embodied with high precision, for instance by means of two honed bores.

For the sake of better sealing, a drop of sealant is typically placed between the base plate 11 and the valve diaphragm 12 in the overpressure valves of the generic type. As a rule, this is done just before the overpressure valve 10 is attached to the wall 2 of the packaging bag 1. The drop is applied centrally through the valve hole 15 to the underside of the valve diaphragm 12, and it takes some time until it spreads into the channel zone. Because of the form of the valve hole according to the invention, the sealant especially quickly passes between the base plate 11 and the valve diaphragm 12, because of the small spacing between the vertices 31, 32 of the hole and the axis 30 connecting the centers, so that the further processing of the overpressure valves 10, or filling and evacuation of the packaging bag 1, can be done directly after the overpressure valves 10 have been attached to the packaging bag 1.

The invention is not limited to two circular overlapping holes. For instance, if the overpressure valve 10 or the middle zone 19 has a rectangular form, then it is also conceivable to form the valve hole from more than two overlapping circular holes that are arranged along a common axis connecting their centers. Arrangements in the form of a cloverleaf, for instance, are also possible. The advantages in terms of the simplicity of tool manufacture and avoidance of creasing of the valve diaphragm are also attainable with such arrangements.

It is noted in addition that the adhesive-free middle zone 19 of the overpressure valve 10 that creates the valve channel can also be formed by securing the side of a valve diaphragm 12 toward the base plate 11 with adhesive over the entire surface, while a thin, flexible cover strip of a plastic film or sheet is glued to the middle zone 19 after the diaphrapm 12.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. An overpressure valve (10) for a packaging container (1), which comprises a base plate (11) secured to an outer wall (2) of the packaging container (1), the base plate includes a central valve hole (15) which is larger than a through hole (3) in the wall (2) of the packaging container (1), a valve diaphragm (12) is secured to the base plate (11) by two parallel peripheral zones (17, 18) that leaves a channel zone, the valve diaphragm covers the valve hole (15) and in a closing position rests tightly against the base plate (11), and the valve hole (15) is embodied by at least two intersecting, circular openings (28, 29).

2. An overpressure valve in accordance with claim 1, in which center points (33, 34) of the circular openings (28, 29) are disposed on a common axis (30) connecting the center points.

3. An overpressure valve in accordance with claim 2, in which the longitudinal axis of the valve hole (15) extends in a longitudinal axis of the channel zone.

4. An overpressure valve in accordance with claim 3, in which the valve hole (15) has a ratio of width to length in a range of from about 1:1.3 to 1:2.

5. An overpressure valve in accordance with claim 3, in which the length of the valve hole (15) is equal to or greater than half a length of the overpressure valve (10) in a same direction of their length.

6. An overpressure valve in accordance with claim 2, in which the valve hole (15) has a ratio of width to length in a range of from about 1:1.3 to 1:2.

7. An overpressure valve in accordance with claim 6, in which the length of the valve hole (15) is equal to or greater than half a length of the overpressure valve (10) in a same direction of their length.

8. An overpressure valve in accordance with claim 2, in which the length of the valve hole (15) is equal to or greater than half a length of the overpressure valve (10) in a same direction of their length.

9. An overpressure valve in accordance with claim 1, in which the longitudinal axis of the valve hole (15) extends in a longitudinal axis of the channel zone.

10. An overpressure valve in accordance with claim 9, in which the valve hole (15) has a ratio of width to length in a range of from about 1:1.3 to 1:2.

11. An overpressure valve in accordance with claim 10, in which the length of the valve hole (15) is equal to or greater than half a length of the overpressure valve (10) in a same direction of their length.

12. An overpressure valve in accordance with claim 9, in which the length of the valve hole (15) is equal to or greater than half a length of the overpressure valve (10) in a same direction of their length.

13. An overpressure valve in accordance with claim 1, in which the valve hole (15) has a ratio of width to length in a range of from about 1:1.3 to 1:2.

14. An overpressure valve in accordance with claim 13, in which the length of the valve hole (15) is equal to or greater than half a length of the overpressure valve (10) in a same direction of their length.

15. An overpressure valve in accordance with claim 1, in which the length of the valve hole (15) is equal to or greater than half a length of the overpressure valve (10) in a same direction of their length.

* * * * *